United States Patent [19]

Denz et al.

[11] 4,440,136

[45] Apr. 3, 1984

[54] ELECTRONICALLY CONTROLLED FUEL METERING SYSTEM FOR AN INTERNAL COMBUSTION ENGINE

[75] Inventors: Helmut Denz; Hans Barho, both of Stuttgart, Fed. Rep. of Germany

[73] Assignee: Robert Bosch GmbH, Stuttgart, Fed. Rep. of Germany

[21] Appl. No.: 314,144

[22] Filed: Oct. 22, 1981

[30] Foreign Application Priority Data

Nov. 8, 1980 [DE] Fed. Rep. of Germany ..... 3042246

[51] Int. Cl.[3] ..... F02B 3/00

[52] U.S. Cl. ..... 123/491; 123/492; 123/480; 123/179 G

[58] Field of Search ..... 123/480, 486, 491, 492, 123/179 G

[56] References Cited

U.S. PATENT DOCUMENTS

| | | | |
|---|---|---|---|
| 4,245,605 | 1/1981 | Rice | 123/480 |
| 4,246,639 | 1/1981 | Carp | 123/491 |
| 4,313,412 | 2/1982 | Hosaka | 123/480 |
| 4,319,327 | 3/1982 | Higashiyama | 123/492 |
| 4,326,488 | 4/1982 | Herth | 123/491 |
| 4,348,727 | 9/1982 | Kobayashi | 123/480 |
| 4,352,158 | 9/1982 | Date | 123/492 |
| 4,363,307 | 12/1982 | Amano | 123/491 |

*Primary Examiner*—Ronald B. Cox

*Attorney, Agent, or Firm*—Edwin E. Greigg

[57] ABSTRACT

An electronically controlled fuel metering system for an internal combustion engine, in which a multiplicative correction is made during warmup and acceleration in accordance with the formula $$K=(1+FM1(n, t1)\cdot FM2(\theta))(1+FBA1(n, t1)\cdot FBA2(\theta)).$$

One exemplary embodiment illustrates a possibility for realizing the correction value formation by circuitry means; in addition, exemplary values are given for individual performance graphs and characteristic curves.

5 Claims, 7 Drawing Figures

Fig. 2a
| $t_l$ [ms] | 1 | 2 | 3 | 4 | 5 | n [1000 1/min] |
|---|---|---|---|---|---|---|
| 5 | 0 | 0 | 0 | 0 | 0 | 0 |
| 4 | 0.2 | 0.2 | 0.1 | 0 | 0 | 0 |
| 3 | 0.5 | 0.5 | 0.4 | 0.1 | 0 | 0 |
| 2 | 0.8 | 0.8 | 0.6 | 0.2 | 0.1 | 0 |
| 1 | 0.8 | 0.8 | 0.6 | 0.3 | 0.2 | 0 |
| $S_{LL}=1$ | 0.4 | 0.2 | 0 | 0 | 0 | 0 |
$F_{M1}(n, t_l, S_{LL})$
Fig. 2b
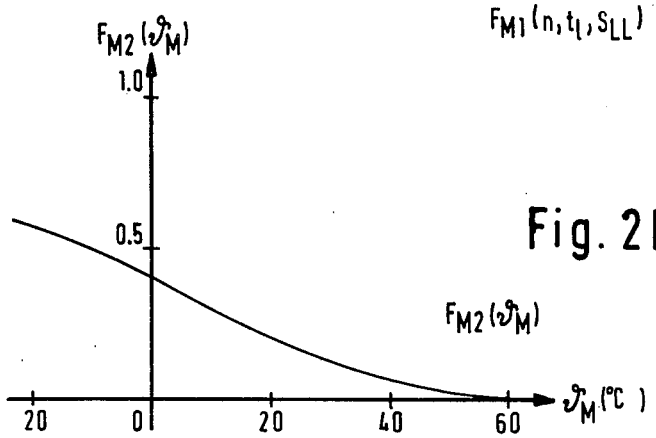
Fig. 3
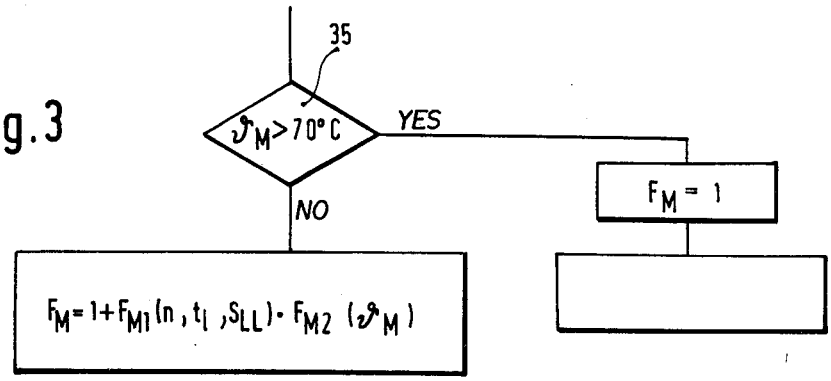

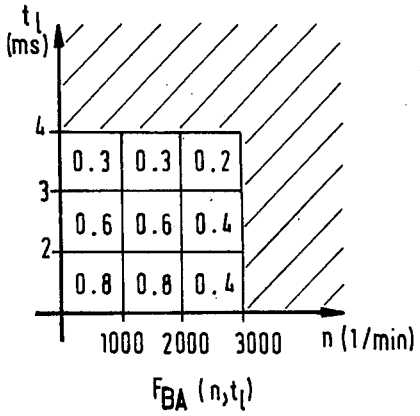
Fig. 4a
Fig. 4b
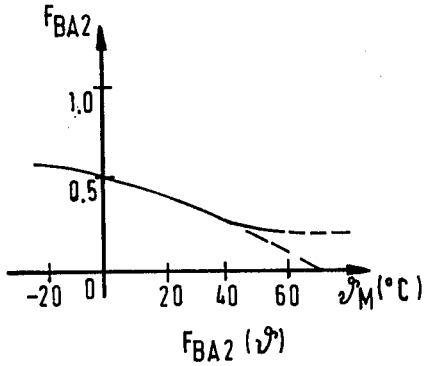
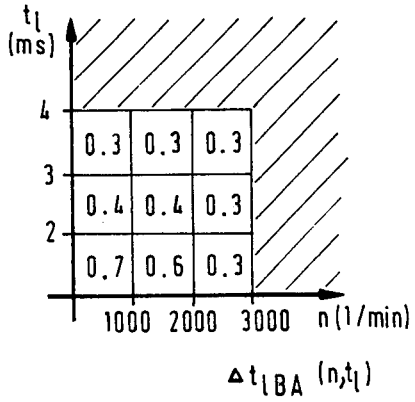
Fig. 4c

ELECTRONICALLY CONTROLLED FUEL METERING SYSTEM FOR AN INTERNAL COMBUSTION ENGINE

BACKGROUND OF THE INVENTION

It has long been known that internal combustion engines must be provided during their warmup phase with a richer mixture than they require directly after they have attained a predetermined operating temperature. This enrichment is necessary in order to compensate for condensation losses on the inner walls of the intake tube and the cylinders, which are still cold at the time of warmup.

As a rule, this warmup enrichment is selected to be accomplished in accordance with both temperaure and rpm. This provision does permit the attainment of satisfactory smoothness in driving; however, the enrichment is not sufficiently sensitive enough for desired clean exhaust to be attained as well. In the known systems, this has been the result of a demand for a wide safety margin, with the priority being placed on good driving smoothness.

OBJECT AND SUMMARY OF THE INVENTION

The electronically controlled fuel metering system according to the invention has the advantage over the prior art that the enrichment of the mixture at a particular time can be adapted to the operating characeristics at that same time, thus allowing the attainment of good results in terms of both driving smoothness and clean exhaust. Sensitive gradations in the operation permit an enrichment during idling which ranges from relatively little to a moderate amount, and in the lower partial-load and lower rpm range a large amount of enrichment may be selected, with a view to good gas intake and thus satisfactory acceleration. For large loads and high rpm, the enrichment may again be low, or it may be eliminated entirely, depending on the type of engine being used. In every case, the fuel metering system according to the invention makes it possible to take into consideration all of the important variables which act as standard characteristics during the warmup phase of the engine.

The invention will be better understood and further objects and advantages thereof will become more apparent from the ensuing detailed description of a preferred embodiment taken in conjunction with the drawings.

BRIEF DESCRIPTON OF THE DRAWINGS

FIG. 1 is a schematic block circuit diagram of the electrical portion of the electronically controlled fuel metering system according to a preferred embodiment and best mode of the invention;

FIGS. 2*a* and 2*b* provide numerical and graph chart examples for warmup enrichment data;

FIG. 3 is a detail of a flow diagram for the purpose of asking when the warmup enrichment ought to be made effective; and FIGS. 4*a*, 4*b* and 4*c* provide numerical examples pertaining to enrichment data during acceleration.

DESCRIPTION OF THE PREFERRED EMBODIMENT

Figure 1:
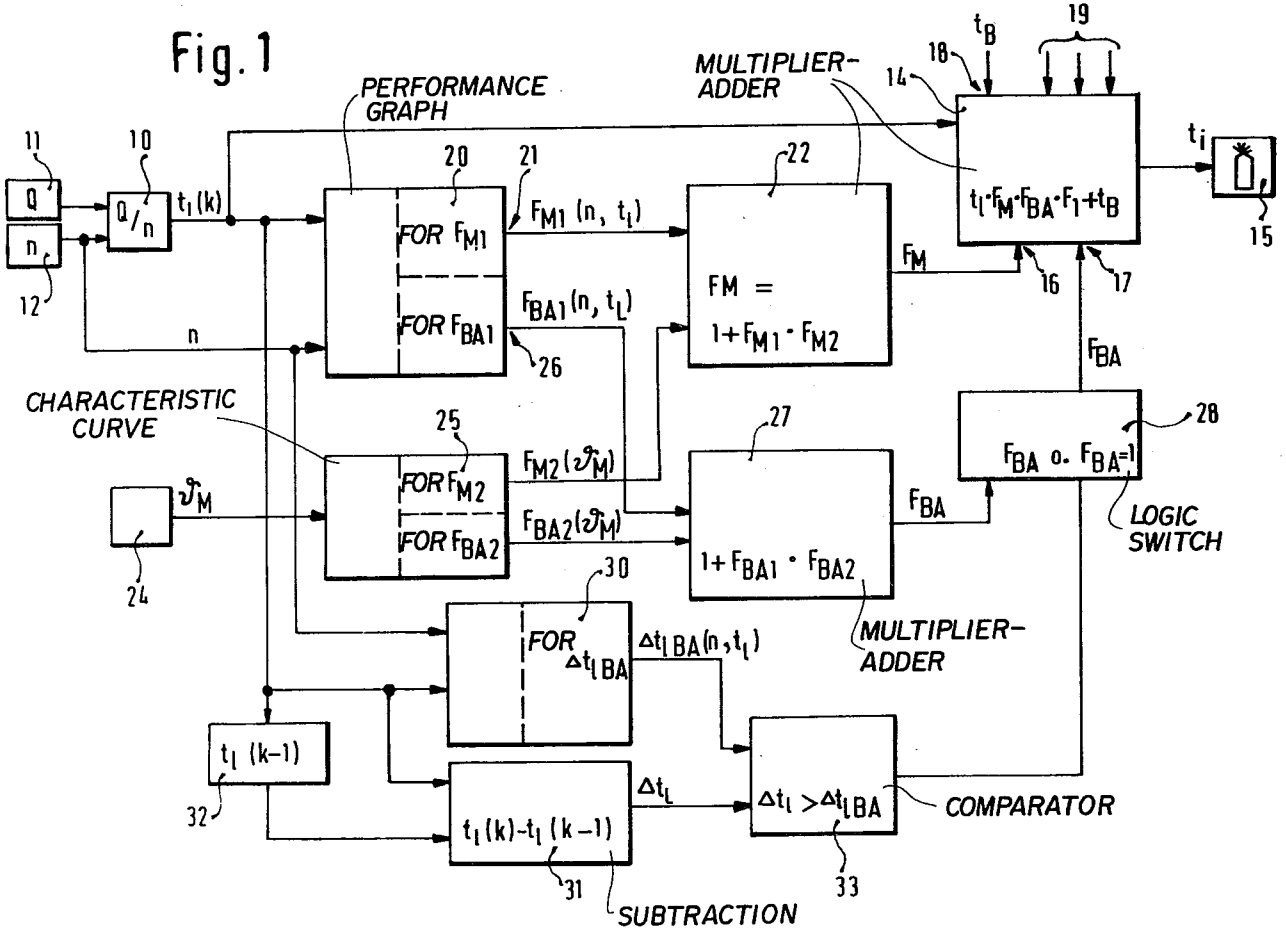

FIG. 1, in the form of a block circuit diagram, illustrates the electrical portion of an electronically controlled fuel metering system for an internal combustion engine having externally supplied ignition. This particular fuel metering system is an injection system. The block circuit diagram as shown symbolizes hardware means of attaining signal generation. In the event of computer control, the signal generation is naturally effected by means of software.

In FIG. 1, a timing element 10 is supplied with input signals from a load sensor 11 and an rpm sensor 12. The timing element 10 forms the quotients of the air throughput in the intake tube divided by the rpm, and thus it emits at its output a volumetric value, designated as t1, which serves as the engine load value. This signal t1, which may also be called the non-corrected injection time, proceeds to a subsequent correction circuit 14 for the purpose of further pulse-duration modulation, and finally reaches at least one injection valve 15. The correction circuit 14 has correction inputs for warmup 16, for acceleration enrichment 17, for operating voltage 18 and for other correction factors 19.

A first performance graph 20, divided into two parts, is connected on its input side with the timing element 10 and the rpm sensor 12. At its first output 21, it sends a warmup correction signal FM1 (n, t1) to a subsequent multiplier -adder 22.

A temperature probe 24 is connected with a function generator for the purpose of generating a characteristic curve, which with view to warmup correction produces a signal FM2 ($\theta$), which is likewise carried to the multiplier -adder 22. There, a correction factor FM is formed in accordance with the formula $$FM = 1 + FM1(n, t1) \cdot FM2(\theta)$$

and this correction factor FM proceeds to the input 16 of the correction circuit 14.

For enrichment during acceleration, the arrangement corresponds to that for the warmup correction. In other words, a correction value FBA1 (n, t1) dependent on rpm and load can be derived from a second output 26 of the performance graph 20, and a temperature-dependent acceleration correction value FBA2 ($\theta$) can be derived from the function generator 25; both values are delivered to a second multiplier-adder 27. In a manner corresponding to the mode of operation of the first multiplier-adder 22, a correction factor FBA is formed in this second multiplier-adder 27 according to the formula $$FBA = 1 + FABA1(n, t1) \cdot FBA2(\theta)$$

which is then carried via a supplementary logic gate or switch element 28 to the acceleration correction input 17 of the correction circuit 14.

In the motor vehicle, the recognition of acceleration is highly significant for the sake of being able to distinguish desirable acceleration processes from mere jerking. To this end, the change in the signal t1, as an output signal of the timing element 10, is detected and a value $\Delta$t1BA (n,t1) is read out of a further performance graph 30 in accordance with rpm. Furthermore, the most recent t1 value at a particular time is compared in a subtraction circuit 31 with the preceding value, which has been stored in an intermediate memory 32. The result of the subtraction is switched, together with the output signal of the performance graph 30, to a comparator 33. The output value of the comparator proceeds in turn to the control input of the logic switch element 28 and determines whether the acceleration correction factor will be passed through to the correction circuit 14.

With the arrangement shown in FIG. 1, the following relationship, expressed as a formula, can be indicated as a correction factor in accordance with the entries in the two multiplier-adders 22 and 27:

$$FM \cdot FBA = (1 + FM1 \cdot FM2)\,(1 + FBA1 \cdot FBA2)$$

Since the individual factors FM1, FM2, FBA1 and FBA2 are derived from performance graphs or characteristic curves, a very sensitive correction can be realized.

FIGS. 2*a* and 2*b* show exemplary values for the performance graphs of the memory 20 and for the function generator in the form of a characteristic curve 25. In the values of the performance graph, it may be seen that when the throttle valve is closed, which signifies idling or overrunning, the numerical values are as a rule 0, so that there is no increase in the quantity of metered fuel. The same is true for high t1 values, which represent high load ranges, and for high rpm values as well. The temperature-dependent output signal of the function generator 25 exhibits a continuously falling curve as temperatures increase; at approximately 60° C., the curve approaches 0.

As already mentioned, FIG. 1 shows one example for realizing a circuit for a normally program-controlled fuel metering computer. In these programs, it is important to assure the fewest possible multiplication operations, for the sake of a short program running time. For this reason, a temperature interrogation will also be provided in the course of a program, and in the event of a sufficient or sufficiently high temperature, the multiplication in connection with the correction will be omitted. This specialized or unique portion of a flow diagram, which may be made the basis for programming, is shown in FIG. 3. An interrogation means 35 is shown with which it is ascertained whether the operating temperature is greater or less than 70° C. In the event of this operating temperature, the output value of the multiplier-adder 22 of FIG. 1 is set to the output value FM = 1, and as a result the desired output signal ti of the correction circuit 14 is attained very rapidly.

In the other case, if this operating temperature has not yet been attained, the multiplication-addition process occurs in block 22 in accordance with the processing of the formula indicated there. Normally, the expenditure for this multiplication process during warmup does not play a very large role, because in this operational status a maximum in dynamics is not yet required, as is the case with maximum rpm.

For the enrichment during acceleration illustrated in FIG. 1, the situation is substantially the same as in the case of warmup enrichment. It is effected in accordance with the formula $$FBA = 1 + \mathrm{FBA1}\,(n, t1) \cdot FBA2\,(\theta),$$

as long as $\Delta$ t1 $< \Delta$t1BA (n,t1).

FIG. 4 illustrates the corresponding performance graph values in the performance graphs 20 and 30 and in the function generator 25. It is clear that an acceleration enrichment is desired only in a specific rpm and load range. It is also desirable for this acceleration enrichment to be dependent on temperature.

The performance graph 30 for $\Delta$ tlBA values is necessary so that, at idling points which are particularly sensitive to bouncing and at lower partial load, an antibounce function in the fuel metering system, which is already provided if possible, can be effective without being influenced by the acceleration enrichment, even at high $\Delta$ t1 values; meanwhile, at somewhat higher partial load points, the acceleration enrichment should be effective if possible already when there are small accelerations (low $\Delta$ t1 values).

As a result of the proposed electronically controlled fuel metering system described above, the following advantages are readily realized and attained:

1. In order to effect the adaptation, by means of a lambda performance graph, of lean-mixture concepts which are optimal in terms of consumption, it is absolutely necessary to provide an intended heavy enrichment during warmup at specific low rpm and load points, because otherwise vehicle performance during warmup is completely unsatisfactory. By means of the "multi-dimensional" warmup adaptation and a relatively great acceleration enrichment with a low trigger threshold, these needs can be met in an optimal fashion.

2. Since in modern vehicles it is recommended that they can be driven directly after starting, the engine is very rapidly made to operate at relatively high rpm and load, where a warmup fuel increase and acceleration enrichment are no longer necessary. The above-described functions enable driving in these ranges immediately, with the leanest possible adaptation; this results in a significant fuel savings in short-distance driving, and especially during cold weather.

3. Improvements are attained in the CO values in exhaust emissions tests, because a leaner adaptation can be attained in the warmup and idling phases than was previously possible.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An electronically controlled fuel metering system for an internal combustion engine, which comprises;

speed sensing means for determining engine rpm values;

temperature sensing means for determining engine temperature values;

basic metering signal generating means for generating a basic metering signal;

signal correction means, connected to receive said basic metering signal, for correcting said basic metering signal to provide an enriched fuel-air mixture, said signal correction means determining at least one correction value K in accordance with the formula K = 1 + K1 × K2, wherein K1 is a first corrective value dependent on at least said basic metering signal and said rpm values, and K2 is a second corrective value which is dependent on at least said engine temperature values, said signal correction means including memory means for storing engine performance graph data including first corrective factors K1 as a function of said basic metering signal and rpm and storing engine characteristic curve data including second corrective factors K2 as a function of engine temperature.

2. An electronically controlled fuel metering system as defined by claim 1, wherein one correction value K determined by said signal correction means is a warmup correction value $F_M$, and the system further comprises means for setting the warmup correction value $F_M$ equal to 1 whenever the sensed engine temperature is above a predetermined temperature.

3. An electronically controlled fuel metering system as defined by claim 1, wherein said basic metering signal generating means includes:

a load sensor for sensing the air quantity Q supplied to the engine;

said speed sensor means for determining engine rpm values n; and load signal generating means for dividing the air quantity value Q by the rpm value n to generate a fill value Q/n which serves as the engine load signal.

4. An eletronically controlled fuel metering system as defined by claim 1, wherein one correction value K determined by said signal correction means is an acceleration correction value $F_{BA}$ which is effective only for rpm values below a predetermined rpm value, for load values below a predetermined load value, and for a load variation values above a predetermined load variation value.

5. An electronically controlled fuel metering system as defined by claim 1, wherein:

said at least one correction value K determined by said signal correction means includes two correction values K, namely a warmup correction value $F_M$ and an acceleration correction value $F_{BA}$;

said first corrective values K1, which are stored in said memory means as a function of engine load and speed, include warmup first corrective values $F_{M1}$ and acceleration first corrective values $F_{BA1}$;

said second corrective values K2, which are stored in said memory means as a function of engine temperature, include warmup second corrective values $F_{M2}$ and acceleration second corrective values $F_{BA2}$;

said signal correction means determines said warmup correction value $F_M$ in accordance with the formula $F_M=1+F_{M1}\times F_{M2}$, and determines said acceleration correction value $F_{BA}$ in accordance with the equation $F_{BA}=1+F_{BA1}\times F_{BA2}$; and said signal correction means further comprises multiplier means for multiplying said basic metering signal by said warmup correction value $F_M$ and said acceleration correction value $F_{BA}$ to provide a metering signal which is corrected for warmup enrichment and acceleration enrichment.

* * * * *